US007082275B2

(12) United States Patent
Portig et al.

(10) Patent No.: US 7,082,275 B2
(45) Date of Patent: Jul. 25, 2006

(54) VARIABLE FORCE BIASING MECHANISM AND ELECTRICAL CONNECTION

(75) Inventors: Harald Portig, Versailles, KY (US); Larry Steven Foster, Lexington, KY (US); Benjamin Alan Askren, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 56 days.

(21) Appl. No.: 10/804,691

(22) Filed: Mar. 19, 2004

(65) Prior Publication Data

US 2005/0207782 A1 Sep. 22, 2005

(51) Int. Cl.
*G03G 15/00* (2006.01)

(52) U.S. Cl. ..... 399/110; 399/117

(58) Field of Classification Search ..... 399/110, 399/111, 112, 116, 117, 119, 121, 122, 123, 399/393; 271/272, 273
See application file for complete search history.

(56) References Cited

U.S. PATENT DOCUMENTS 5,095,335 A * 3/1992 Watanabe et al. ..... 399/111
5,136,333 A * 8/1992 Craft et al. ..... 399/111
5,486,898 A * 1/1996 Fujii et al. ..... 399/112
5,794,103 A * 8/1998 Oh ..... 399/119
5,805,959 A 9/1998 Hazama et al.
5,828,929 A 10/1998 Watanabe et al.
5,848,331 A 12/1998 Fromm
5,881,341 A 3/1999 Kumar et al.
5,983,062 A 11/1999 Sameshima
6,201,938 B1 * 3/2001 Hollar et al. ..... 399/67
6,253,046 B1 * 6/2001 Horrall et al. ..... 399/124
6,397,026 B1 * 5/2002 Buxton et al. ..... 399/111
6,535,705 B1 * 3/2003 Asakura et al. ..... 399/119
6,580,888 B1 6/2003 Horrall et al.

* cited by examiner

*Primary Examiner*—Diego Gutierrez
*Assistant Examiner*—Mirellys Jagan
(74) *Attorney, Agent, or Firm*—Coats & Bennett, P.L.L.C.

(57) ABSTRACT

A biasing mechanism in an image forming apparatus exerts a variable force on a removable cartridge unit to generate a nip force between a roller in the cartridge unit and another roller. A pivot member is fixed to the apparatus housing. An arm is pivotally mounted in the housing about the pivot member, with the arm in contact with a protrusion on the cartridge unit. A force generating member is mounted in the housing and contacts the arm so as to urge the arm to pivot about the pivot member and press against the cartridge unit. The resulting force exerted on the cartridge unit by the arm varies according to the point of contact between the cartridge unit and the arm. In some embodiments, the arm and the cartridge unit protrusion are electrically conductive, and an electrical contact is established as the arm is pressed against the protrusion.

16 Claims, 4 Drawing Sheets

VARIABLE FORCE BIASING MECHANISM AND ELECTRICAL CONNECTION

BACKGROUND

The present invention relates generally to the field of image forming and in particular to a variable force biasing mechanism and an electrical connection for a removable cartridge unit in an image forming apparatus.

The electrophotographic image forming process is well known in the art. A photoconductive surface, such as a drum, roller, or belt, is uniformly charged to a first voltage level. A latent image is then formed on the photoconductive surface by incident optical energy, such as a laser beam. The latent image is developed by applying toner to the photoconductive surface. The toner is typically applied by a developer roller, the surface of which is charged to a second voltage, with toner electrostatically adhered thereto. The toner is electrostatically transferred from the developer roller to the latent image on the photoconductive surface by the voltage difference between the developer roller surface and the latent image area on the photoconductive surface.

Critical factors in the accurate development of latent images are the force applied along the contact between the developer roller and the photoconductive surface, known in the art as the nip force, and the uniformity of the nip force along the nip or contact area. Among other factors, the optimal nip force is determined by properties of the toner. As the state of the art in toner composition advances, the optimal nip force between the developer roller and photoconductive surface, for a given toner formulation, may change.

The nip force is typically controlled by housing the photoconductive surface, such as a photoconductive drum, and the developer roller in a common replaceable cartridge unit, with the nip force controlled within the cartridge unit by low rate springs. The nip force adjustment is accomplished by altering the low rate springs within the cartridge, so that new cartridges, containing the latest formulation of toner, can be installed in existing machines and function at the latest desired nip force.

In addition to control of the nip force, a recurring challenge in the design of removable cartridge units is the provision of electrical contacts for biasing the photoconductive drum and developer roller surfaces to their required voltages, and in grounding these elements. These contacts should provide reliable electrical connectivity, but exert minimal influence on the carefully controlled nip force. Additionally, electrical contacts may be necessary for a doctor blade and/or toner-adder roller, and possibly characterization electronic circuits.

A recent advance in the design of electrophotographic image forming devices separates the developer roller and the PC drum into distinct removable cartridge units. A removable developer unit stores fresh toner of one color, and includes a developer roller, a toner-adder roller, doctor member and three agitating paddles. A removable cleaner unit contains a photoconductive drum, a charge roller, a toner cleaner unit, and a waste toner auger. Mechanical hardware in the machine housing urges the developer unit against the cleaner unit, generating a nip force between the developer roller and the photoconductive drum. However, since this hardware resides in the machine, it is difficult to adjust the nip force to different values for different developer units.

SUMMARY

The present invention relates to an image forming apparatus having a housing and including a cartridge unit removably mounted in the housing. In particular, the image forming apparatus includes a pivot member fixed to the housing. An arm is pivotally mounted in the housing about the pivot member, with the arm in contact with the cartridge unit. A force generating member is mounted in the housing and contacts the arm so as to urge the arm to pivot about the pivot member and press against the cartridge unit. The resulting force exerted on the cartridge unit by the arm varies according to the point of contact between said cartridge unit and the arm. In some embodiments, the arm and its contact point on the cartridge unit are electrically conductive, and establish an electrical contact.

In another aspect, the present invention relates to a method of controlling the force exerted on different removable cartridge units by an image forming apparatus. The method includes providing at least one arm pivotally mounted in the image forming apparatus about a pivot point and biased by a force generating member into contact with a removable cartridge unit having at least one protrusion, where the arm includes a contact member having a longitudinal extent and where the protrusion contacts the arm along the contact member. The method includes positioning a first protrusion on a first removable cartridge unit to contact the contact member at a first longitudinal position, the arm thereby exerting a first force on the first cartridge unit. The method also includes positioning a second protrusion on a second removable cartridge unit to contact the contact member at a second longitudinal position different from the first longitudinal position, the arm thereby exerting a second force on the second cartridge unit different from the first force. In some embodiments, the arm and the protrusion are electrically conductive, and establish an electrical contact.

In yet another aspect, the present invention relates to an image forming apparatus including a housing that includes two fixed pivot points. The image forming apparatus also includes two arms, each pivotally mounted about a pivot point, each arm including a force receiving member and a contact member having a longitudinal extent. The image forming apparatus further includes two force generating members, each exerting a first force at a position on the force receiving member of a different arm, biasing the arm to pivot about a pivot point. The image forming apparatus additionally includes at least one removable cartridge unit housing a first roller and having two protrusions, each of which contacts the contact member of a different arm along the longitudinal extent thereof such that the arm exerts a second force on the cartridge unit through the protrusion. In some embodiments, the arm and the protrusion are electrically conductive, and establish an electrical contact.

DETAILED DESCRIPTION OF THE INVENTION

The present invention is described herein with respect to an image forming apparatus having two separate removable cartridge units for each image forming station, although it is not limited to such an application. In this embodiment, one removable cartridge unit includes a photoconductive drum (PC drum), which is uniformly charged to a first voltage, a latent image formed thereon by irradiation by a laser, which latent image is developed by the application of toner and the developed image transferred to a media sheet or intermediate transport belt. A second removable cartridge includes a developer roller operative to apply toner to the PC drum in the first removable cartridge unit. The cartridge unit containing the developer roller may additionally include a reservoir of toner, and various rollers and other mechanical systems for stirring the toner and transporting it to the developer roller.

When the image forming apparatus is in an operative condition, one or the other of the removable cartridge units may be rigidly fixed within the housing of the image forming apparatus. By use of the variable-force biasing mechanism of the present invention, the non-fixed cartridge unit is pressed against the fixed cartridge unit to develop a nip force between the developer roller and the PC drum. For simplicity of explanation, the following description will assume that the present invention applies an urging force to a cartridge unit containing a developer roller (which in turn generates a nip force as it presses against a PC drum), although those of skill in the art will readily recognize that the present invention may be advantageously applied to the cartridge unit containing the PC drum, either in lieu of or in addition to the embodiment described.

Figure 1:
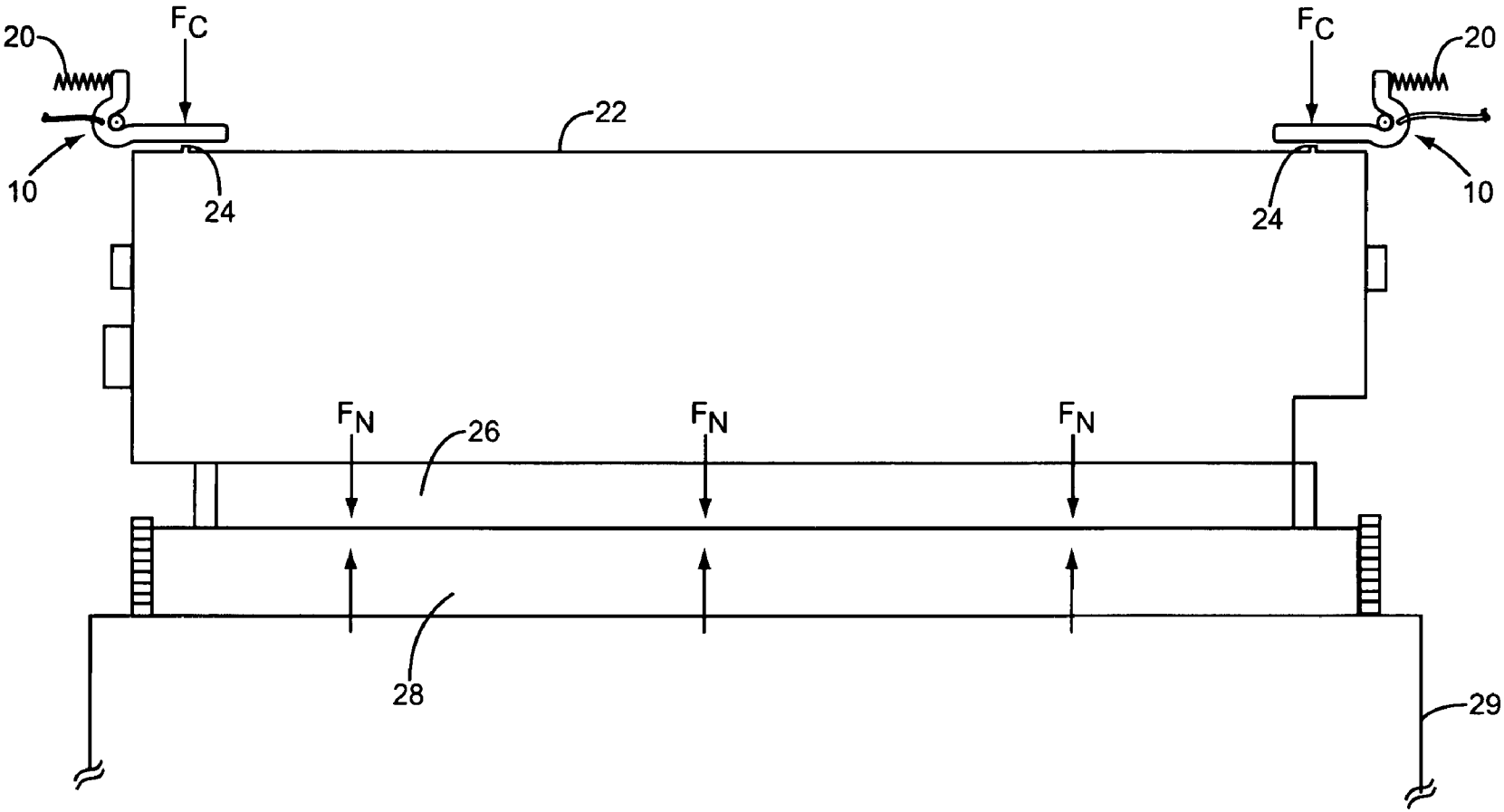
FIG. 1 is a top view of a functional representation of the biasing mechanism of the present invention, and two removable cartridge units.

FIG. 1 depicts one embodiment of a variable-force biasing mechanism 10 according to the present invention (shown in greater detail in FIG. 2) in an operative condition, with a removable cartridge unit 22 installed within the housing of an image forming apparatus (not shown). In this embodiment, the removable cartridge unit 22 includes a partially exposed developer roller 26. The developer roller 26 is in contact along the longitudinal surface thereof with a PC drum 28 housed in, and partially exposed from, a second removable cartridge unit 29. A nip force $F_N$ is developed between the developer roller 26 and the PC drum 28 along the common surface thereof, as indicated by force vectors in FIG. 1, by action of the biasing mechanisms 10.

The action of the biasing mechanism 10 is described with reference to FIG. 2. Biasing mechanism 10 comprises a pivoting arm 11 pivotally disposed about a pivoting member 18 and acted upon by a force-generating member 20. The pivoting arm 11 may be formed of metal, plastic, composites, or any appropriate material. In some embodiments described herein, the pivoting arm 11 is electrically conductive, and biased to a particular voltage by a wire 13 attached at electrical connection 15. However, in general, the pivoting arm 11 need not be electrically conductive, and the wire 13 and electrical connection 15 may be omitted when electrical connectivity through the biasing mechanism 10 is not required or desired.

The pivoting arm 11 includes a bias force receiving member 12, and a contact member 14 having a longitudinal extent and disposed along one edge of the removable cartridge unit 22 when the latter is installed in the image forming apparatus. The force receiving member 12 receives a biasing force from the force generating member 20, which in the embodiment of FIG. 2, is a spring in compression. The force of the spring 20 induces a counter-clockwise moment (in the configuration depicted in FIG. 2) in the pivoting arm 11 about pivot member 18, which is rigidly affixed to the image forming apparatus housing. The counter-clockwise moment urges the contact member 14 into contact with the nearest portion of the removable cartridge unit 22.

A raised protrusion 24 is formed at a predetermined location on the surface of the removable cartridge unit 22 adjacent the contact member 14. Contact between the pivoting arm 11 and the cartridge unit 22 is limited to the contact between the protrusion 24 and the contact member 14. The protrusion 24 may be located at any point along the side of the removable cartridge unit 22 that is within the longitudinal extent of the contact member 14. For example, dotted-line elements 24' and 24" depict alternative representative locations for the protrusion 24. In the embodiments of the present invention in which the pivoting arm 11 is electrically conductive and biased to a voltage, the protrusion 24 is also electrically conductive, and an electrical contact is established by the contact member 14 pressing against the protrusion 24. However, in general, the protrusion 24 need not be electrically conductive.

The transmission of force to the removable cartridge unit 22 by the biasing mechanism 10 is described with reference to the free body diagram of the pivoting arm 11 depicted in FIG. 3. The spring 20 generates a force $F_S$ on the force-receiving member 12, generating a torque in the counter-clockwise direction about the pivot center 16. For the purposes of the current description, the force $F_S$ may be viewed as applied to a point at the center of the contact area between spring 20 and force-receiving member 12. In this case, the counter-clockwise torque induced on the pivot arm 11 has a magnitude of $F_S \times d_1$, where $d_1$ is the distance from the pivot point 16 to the point of application of the force $F_S$. In static equilibrium, this torque is countered by an equal and opposite, i.e., clockwise, torque generated at the point of contact between the protrusion 24 and the contact member 14, denoted in FIG. 3 as $F_C$ (as depicted from the point of view of the pivot arm 11—in operation, the pivot arm 11 exerts the force $F_C$ on the protrusion 24, in the opposite direction as that depicted in FIG. 3). The magnitude of this clockwise torque is $F_C \times d_2$, where $d_2$ is the distance from the pivot point 16 to the protrusion 24 (under the simplifying assumption that the protrusion 24 contacts the contact member 14 at a point). From this relationship, $$F_S \times d_1 = F_C \times d_2 \text{ or}$$

$$F_C = F_S \times \frac{d_1}{d_2}$$

Hence, the force $F_c$ urging the cartridge unit 22 against a cartridge unit 29 is inversely proportional to $d_2$, the distance of the protrusion 24 from the pivot point 16. That is, referring to FIG. 2, protrusion 24" would generate a stronger nip force than would protrusion 24'. In one embodiment, wherein the contact member 14 has an effective longitudinal extent of approximately 16 mm, a force ranging from about 45% to about 150% of the spring 20 force $F_S$ may be applied to the removable cartridge unit 22 by the selective location of the protrusion 24 along the contact member 14.

Figure 4:
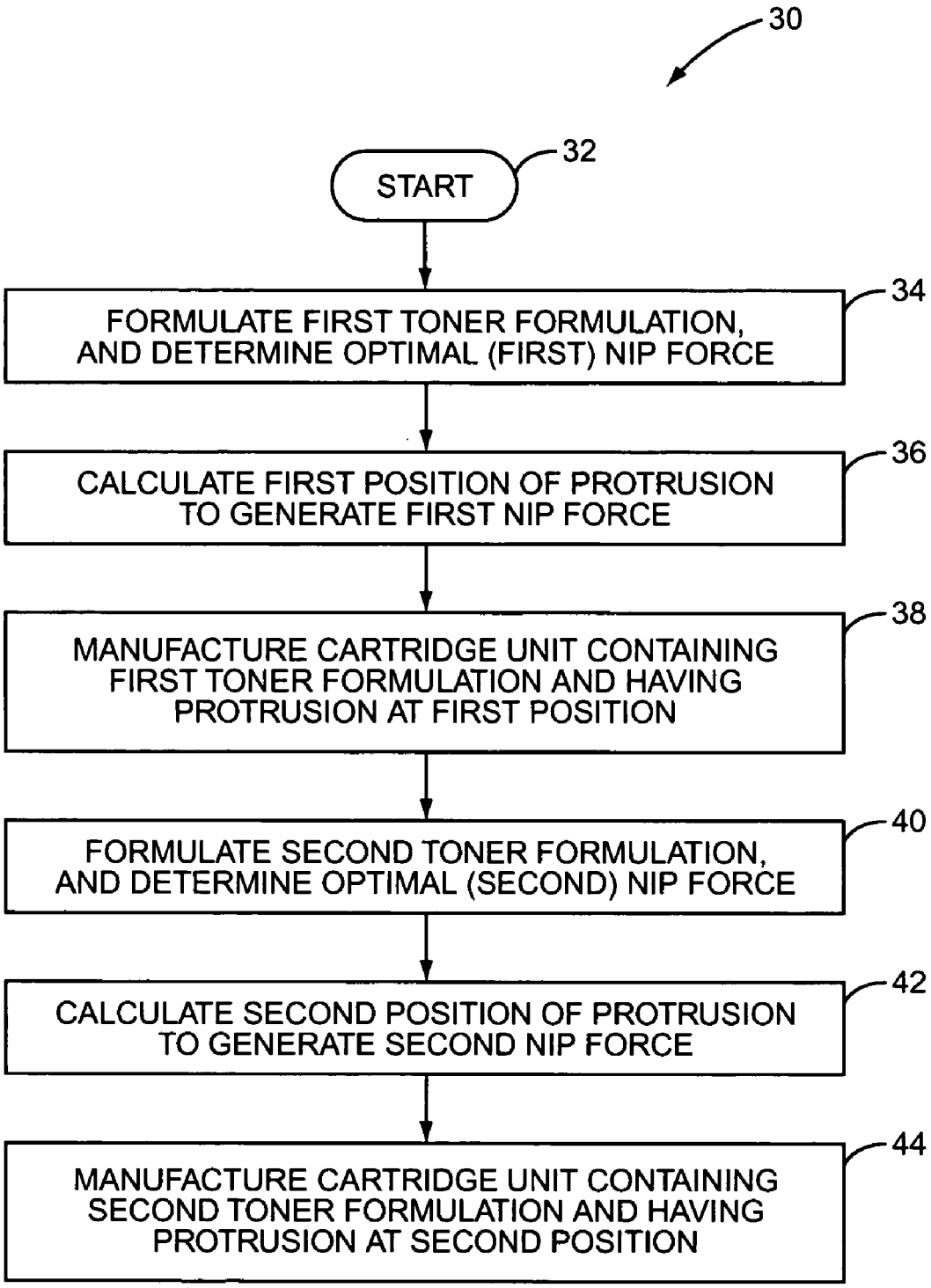
FIG. 4 is a flow diagram of a method of altering the nip force as a toner formulation is changed.

The present invention is particularly suited to adjusting the nip force between the developer roller 26 and PC drum 28 in an image forming apparatus as the toner formulation changes. A method for adjusting the nip force is depicted in flow diagram form in FIG. 4, beginning at block 32. A first toner formulation is generated, and the optimal nip force for that toner formulation (the first nip force) is determined at block 34. A first position for protrusions 24 in a developer cartridge unit 22 is calculated, at step 36, which will generate the first nip force when the cartridge unit 22 is operatively installed in the image forming apparatus. The developer cartridge unit is then manufactured at step 38, containing toner of the first toner formulation and having protrusions 24 at the first position. This model of developer cartridge unit 22 may then be used in all image forming devices of the appropriate model.

A second toner formulation may then be developed, the second toner formulation perhaps offering some benefit over the first toner formulation. The optimal nip force for the second toner formulation (the second force) is determined at step 40. At step 42, assuming the required second force is different than the first force (that required by the first toner formulation), a second position for protrusions 24 is calculated that will generate the second force when the developer cartridge unit 22 is operatively installed in an image forming apparatus. The developer cartridge 22 is then manufactured at step 44, containing toner of the second toner formulation and having protrusions 24 at the second position. This model of developer cartridge unit 22 may then replace the first model of cartridge units 22 in some or all image forming devices of the appropriate model. In this manner, either the first or second toner formulation may be utilized by simply inserting the appropriate cartridge unit 22, and the appropriate nip force for the toner contained therein is applied between the developer roller 26 and PC drum 28, without requiring any adjustment, calibration, or alteration of the image forming apparatus.

Figure 2:
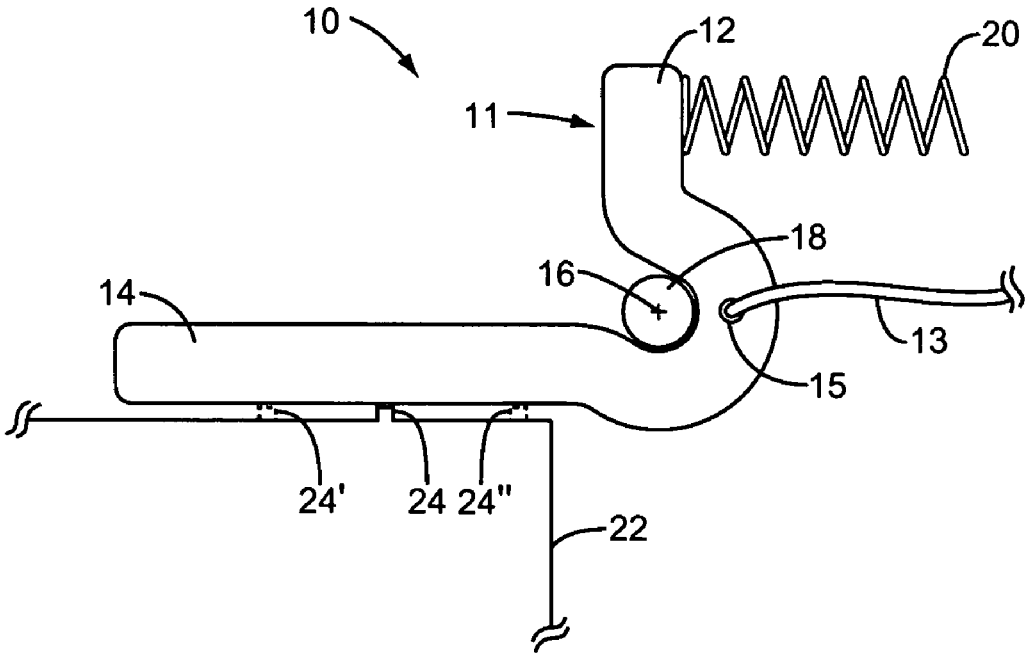
FIG. 2 is a biasing mechanism according to one embodiment of the present invention.
Figure 3:
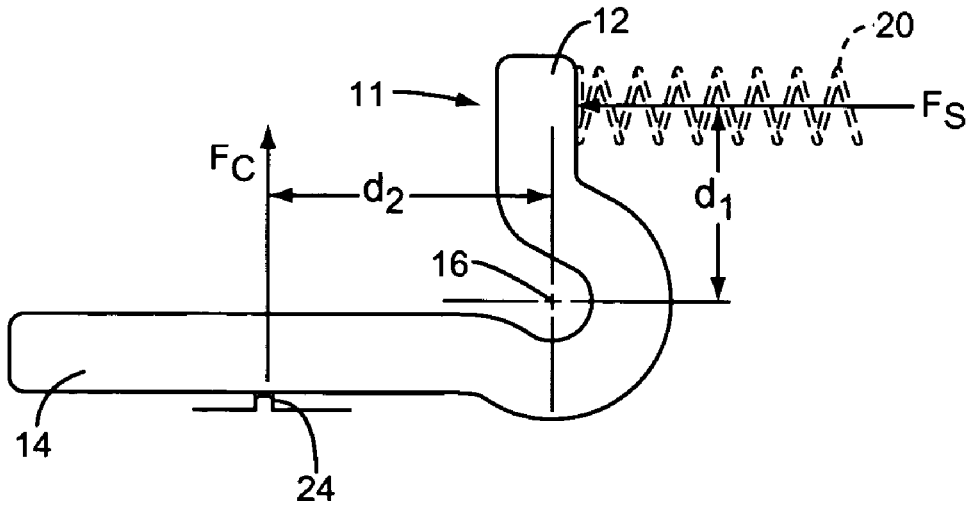
FIG. 3 is a free body diagram of one biasing mechanism, depicting forces acting thereon.
Figure 5A:
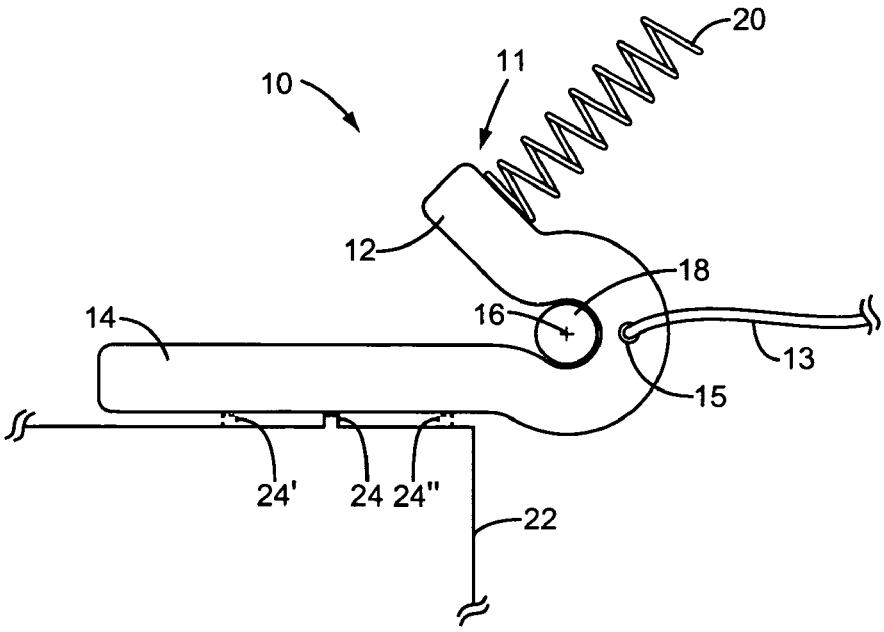
FIGS. 5A and 5B are biasing mechanisms according to further embodiments of the present invention.
Figure 5B:
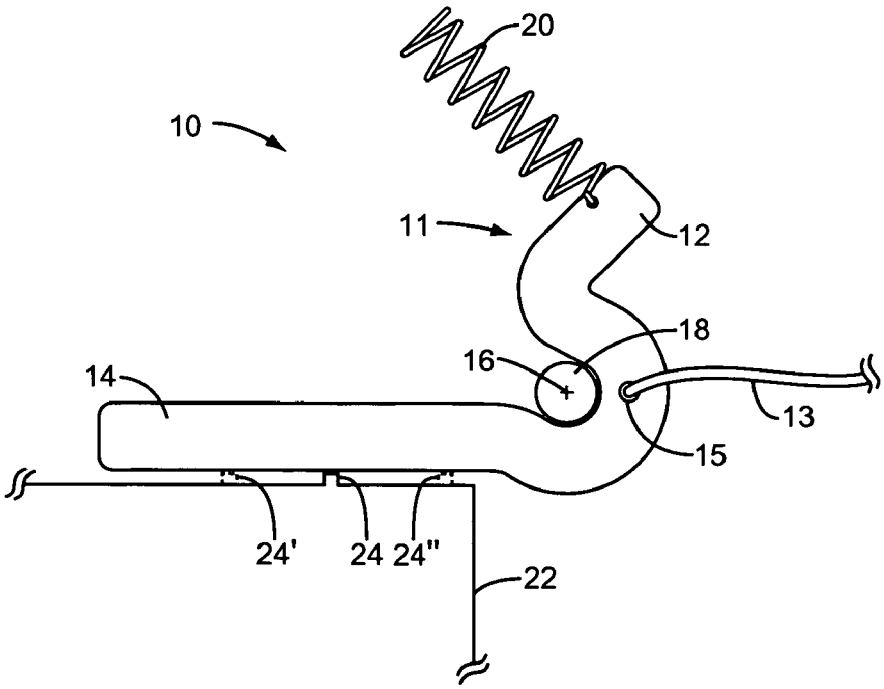

The pivoting arm 11 is depicted in FIGS. 1, 2 and 3 in a generally "L" shaped configuration, with the force receiving member 12 and contact member 14 extending from the pivot point 16 at a generally right angle with respect to each other. The present invention is not limited to this configuration. For example, FIG. 5A depicts an electrical contact 10 wherein the force receiving member 12 and contact member 14 form an acute angle. As another example, FIG. 5A depicts an electrical contact 10 wherein the force receiving member 12 and contact member 14 form an obtuse angle. Additionally, the force producing member 20 in FIG. 5B is a spring in tension. The various relative shapes, sizes, and placement of the elements of the biasing mechanism 10 of the present invention may be varied as required for a particular implementation. All such embodiments fall within the scope of the present invention, which is defined by the claims and not limited to any particular disclosed embodiment thereof.

Although described herein with respect to an image forming apparatus utilizing a PC drum and developer roller in separate cartridge units, the present invention is not limited to this application. As those of skill in the art will readily recognize, the biasing mechanism of the present invention is mounted in a housing, and applies a variable force against a separate unit or member. That unit may comprise a removable cartridge housing a PC drum, a developer roller, or both (or neither). In a cartridge unit housing both a PC drum and developer roller, the present invention may control the nip force between the two by applying a bias force to the cartridge unit that is mechanically translated within the cartridge unit to a nip force. Alternatively, it may urge the PC drum of a removable cartridge unit against an intermediate transfer belt or media sheet, wherein a precise nip force is required to transfer a developed image from the PC drum to the belt or sheet. Those of skill in the art will recognize various other applications of the present invention wherein providing a variable bias force is advantageous, within the broad practice of the present invention as claimed herein.

Additionally, although FIG. 1 depicts two biasing mechanisms 10 in contact with the removable cartridge unit 22, the present invention is not so limited. For example, a single biasing mechanism 10, positioned in the center of the removable cartridge unit 22 and oriented at right angles to the biasing mechanisms 10 as displayed in FIG. 1 (e.g., into or out of the plane of the image of FIG. 1) may be sufficient. Alternatively, a plurality of biasing mechanisms 10 may be needed, arrayed along the surface of the removable cartridge unit 22 as necessary, to provide sufficient bias force for a given application. Note that positioning the biasing mechanisms 10 in the body of the image forming apparatus decreases the cost of the removable cartridge unit 22, which need not include the springs, levers, and the like necessary to separately generate the proper nip force. This cost benefit over prior art biasing methods is multiplied as the number of biasing mechanisms 10 increase.

According to some embodiments of the present invention, in addition to applying a variable force to a removable cartridge unit, the biasing mechanism serves as an electrical contact that provides electrical connectivity to the cartridge unit. This may be advantageous, for example, to charge the surface of a developer roller (or PC drum) in the removable cartridge unit, and/or to provide a ground connection. In these embodiments, as depicted in FIG. 2, the pivoting arm 11 is electrically conductive, and may be biased to a particular voltage by an electrical contact 15 with wire 13, which is connected to control electronics (not shown). Note that the electrical contact 15 may be located anywhere on the pivoting arm 11, as necessary or convenient for a particular application. Alternatively, electrical connectivity may be established through an electrically conductive spring 20.

In these embodiments, the protrusion 24 of the removable cartridge unit 22 is also electrically conductive. As both the contact member 14 and the protrusion 24 are electrically conductive, an electrical connection is established and maintained between the variable force biasing mechanism 10 and the removable cartridge unit 22 for as long as the cartridge unit 22 is operatively installed in the image forming apparatus.

For example, FIG. 1 depicts two variable force biasing mechanisms according to one embodiment of the present invention, that additionally serve as electrical connectors. In this embodiment, each electrical connector may supply a different voltage level connection to the removable cartridge unit, for example, a bias voltage and a ground. Alternatively, each electrical connector may provide the same voltage. Additional connectors may be provided, as necessary or desired, to accommodate the required electrical connections and/or bias force application requirements. Using the biasing mechanism 10 as an electrical contact not only decreases the cost of both the image forming apparatus and the removable cartridge unit 22 by avoiding the need for a separate electrical contact, but additionally affords greater control over the nip force generated and maintained by the biasing mechanism 10. Effective coupling of prior art electrical contacts for removable cartridge units 22 typically require a coupling force of 100–200 grams. Depending on the design and location of the contacts on the removable cartridge unit 22, this force may augment or counteract the nip force generated by the biasing mechanism 10, making precise control of the nip force more difficult. Furthermore, variations in the electrical contact mating force may introduce or exasperate hysteresis effects in the nip force generated by the biasing mechanism 10.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming apparatus having a housing and including a cartridge unit removably mounted in said housing, comprising:

a pivot member fixed to said housing;

a first arm pivotally mounted in said housing about said pivot member, said arm in contact with said cartridge unit; and a force generating member mounted in said housing and contacting said arm so as to urge said arm to pivot about said pivot member and press against said cartridge unit;

whereby the force exerted on said cartridge unit by said arm varies according to the point of contact between said cartridge unit and said arm;

wherein said removable cartridge unit includes a photoconductive drum carrying a latent image.

2. The image forming apparatus of claim 1 wherein said force generating member is a spring.

3. The image forming apparatus of claim 1 further comprising a second arm, said first and second arms contacting said cartridge unit at opposite ends thereof.

4. The image forming apparatus of claim 1 wherein said removable cartridge unit includes a developer roller operative to develop a latent image by supplying toner thereto.

5. The image forming apparatus of claim 1 wherein said removable cartridge unit includes one of a developer roller and a photoconductive drum, and wherein the variable force applied to said cartridge unit by said arm contributes to the nip force between said one of a developer roller or photoconductive drum and the other of a developer roller or photoconductive drum.

6. The image forming apparatus of claim 1 wherein said arm includes a contact member having a longitudinal extent, and where said cartridge unit contacts said arm along said contact member.

7. The image forming apparatus of claim 6 wherein said arm includes a force receiving member, and wherein said force receiving member and said contact member extend from said pivot member at a generally right angle.

8. The image forming apparatus of claim 6 wherein said cartridge unit includes a protrusion in the direction of said arm such that contact between said cartridge unit and said arm occurs at said protrusion.

9. The image forming apparatus of claim 8 wherein the force exerted on said cartridge unit by said arm varies according to the position of contact of said protrusion along said contact member.

10. The image forming apparatus of claim 9 wherein said force ranges from about 45% to about 150% of the force of said force generating member.

11. The image forming apparatus of claim 10 wherein said contact member has a length of about 16 mm.

12. An image forming apparatus, comprising:

a housing, including two fixed pivot points;

two arms, each pivotally mounted about a different said pivot point, each said arm including a force receiving member and a contact member having a longitudinal extent;

two force generating members, each exerting a first force at a position on the force receiving member of a different said arm, biasing said arm to pivot about said pivot point; and at least one removable cartridge unit housing a first roller and having two protrusions, each of which contacts the contact member of a different said arm along the longitudinal extent thereof such that each said arm exerts a second force on said cartridge unit through said protrusion.

13. The image forming apparatus of claim 12 wherein said arms and pivot points are disposed in said housing such that said contact members contact said protrusions proximate each end of said cartridge unit, in an axial direction of said first roller.

14. The image forming apparatus of claim 13 wherein the magnitude of said second force varies in response to the relative position of each said protrusion along the longitudinal extent of each said contacting contact member.

15. The image forming apparatus of claim 14 wherein the magnitude of said second force is equal to the magnitude of said first force multiplied by the distance from said pivot point to said position of application on force receiving member, divided by the distance from said pivot point to the position of contact between said protrusion and said contact member.

16. The image forming apparatus of claim 14 wherein said second force is a component of the nip force between said first roller and a second roller in said image forming apparatus.

* * * * *